US009610613B2

(12) United States Patent
Rieck

(10) Patent No.: US 9,610,613 B2
(45) Date of Patent: Apr. 4, 2017

(54) PORTABLE CLASSIFIER SCREEN SHAKER ASSEMBLY

(71) Applicant: Robert Rieck, Mission Viejo, CA (US)

(72) Inventor: Robert Rieck, Mission Viejo, CA (US)

( * ) Notice: Subject to any disclaimer, the term of this patent is extended or adjusted under 35 U.S.C. 154(b) by 0 days.

(21) Appl. No.: 14/756,066

(22) Filed: Jul. 28, 2015

(65) Prior Publication Data

US 2015/0336134 A1 Nov. 26, 2015

Related U.S. Application Data

(63) Continuation-in-part of application No. 13/998,900, filed on Dec. 18, 2013, now Pat. No. 9,095,881.

(60) Provisional application No. 61/848,692, filed on Jan. 9, 2013.

(51) Int. Cl.

| | |
|---|---|
| ***B07B 1/02*** | (2006.01) |
| ***B07B 1/28*** | (2006.01) |
| ***B07B 1/36*** | (2006.01) |

(52) U.S. Cl.

CPC ..... *B07B 1/28* (2013.01); *B07B 1/02* (2013.01); *B07B 1/36* (2013.01)

(58) Field of Classification Search

CPC .... B07B 1/02; B07B 1/28; B07B 1/36; B07B 1/42; B07B 1/46

See application file for complete search history.

(56) References Cited

U.S. PATENT DOCUMENTS

| | | | | | |
|---|---|---|---|---|---|
| 1,948,797 | A * | 2/1934 | Nicolai | B03B 5/02 | 209/275 |
| 2,075,097 | A * | 3/1937 | Power | B07B 1/30 | 160/380 |
| 2,612,896 | A * | 10/1952 | Fox | A24F 19/14 | 131/235.1 |
| 3,315,807 | A * | 4/1967 | Rosen | A63H 33/32 | 209/315 |
| 3,744,631 | A * | 7/1973 | Smith | B07B 1/28 | 209/319 |
| 3,908,720 | A * | 9/1975 | Garnett | B65G 69/186 | 141/286 |
| 4,289,241 | A * | 9/1981 | Litrap | B03B 5/02 | 209/44 |
| 4,323,160 | A * | 4/1982 | Cowgill | A23F 5/02 | 209/235 |
| 4,400,269 | A * | 8/1983 | Gordon, Jr. | B03B 5/02 | 209/447 |
| 5,423,430 | A * | 6/1995 | Zaffiro | B07B 1/02 | 209/315 |
| 6,925,961 | B2 * | 8/2005 | Langdale | A01K 1/0114 | 119/161 |

(Continued)

*Primary Examiner* — Joseph C Rodriguez

(74) *Attorney, Agent, or Firm* — I. Michael Bak-Boychuk

(57) ABSTRACT

A pedal articulated screen shaker assembly supporting a classifying screen at its top in an alignment over a collection receptacle is provided with an annular nested dust shielding combination suspended below the screen. The dust shielding combination comprises a conforming set of frustoconical elastomeric membrane segments in a nested arrangement with the exterior one of the segments perforated throughout its full circumference by perforations that are bridged by flexible flaps formed in the overlying interior segment that are lifted from their bridging alignment by the lateral movement imparted to the shielding combination.

6 Claims, 8 Drawing Sheets

(56) References Cited

U.S. PATENT DOCUMENTS

| | | | | |
|---|---|---|---|---|
| 8,065,777 | B2 * | 11/2011 | Lin | A47J 47/18 15/260 |
| 8,113,355 | B1 * | 2/2012 | Peterson | B03B 5/02 209/235 |
| 8,613,401 | B2 * | 12/2013 | Fornaci | E21F 5/10 169/64 |
| 9,095,881 | B2 * | 8/2015 | Rieck | B07B 1/28 |
| 9,132,452 | B2 * | 9/2015 | Trivette | B07B 1/46 |
| 9,289,800 | B1 * | 3/2016 | Rosado | A01B 1/08 |
| 2013/0180892 | A1 * | 7/2013 | Marrapodi | B65F 1/0033 209/10 |

* cited by examiner

PORTABLE CLASSIFIER SCREEN SHAKER ASSEMBLY

REFERENCE TO RELATED APPLICATIONS

This application is a continuation-in-part of U.S. patent application Ser. No. 13/998,900 filed on Dec. 18, 2013, which, in turn, obtains the benefit of the earlier filing date of U.S. Provisional Patent Application No. 61/848,692 filed on Jan. 9, 2013.

STATEMENT CONCERNING GOVERNMENT INTEREST

None.

BACKGROUND OF THE INVENTION

Field of the Invention

The present invention relates to prospecting devices, and more particularly to a foot operated shaker assembly useful to shake and agitate screen bottomed classifying pans in coordination with the manual shoveling strokes to sift and separate, or classify, the ore bearing soil from any admixed rock aggregate shoveled into the pan.

Description of the Prior Art

Precious metals like gold and silver are characterized by their very high specific gravity, fairly low melting temperatures and also a very malleable or ductile material structure that is easily fragmented both by the high temperatures of the tectonic processes and also by the subsequent weathering when these processes cool down. As result the recovery of these highly macerated and finely distributed metals is invariably associated with moving enormous quantities of ore-bearing soil and rock which then needs to be sorted, classified and thereafter processed to a point where the sought metal is finally isolated and then collected. Of course, the back-breaking movement of these huge volumes of the earth's mantle produced all sorts of mechanical, chemical and hydraulic aids which, by their cost, complexity and toxic consequence are mainly useful in larger ground formations rich in the metal deposits, leaving the small, highly localized by alluvial processes, placer deposits to the individual prospector.

Of course, the same high specific gravity and easily fractioned, low strength material structure of the mined precious metal resulted in similar, or even greater, need for mechanical assistance at these smaller placer mining sites and to assist this individual prospector, way out in the desolate terrain where these alluvial concentration sites are often found, various more compact, trailer borne sorting and sifting assemblies were devised as exemplified in the teachings of U.S. Pat. No. 5,421,461 to Razic; U.S. Pat. No. 5,842,578 to Cordeiro; and many others. While suitable for the purposes intended, each of the foregoing examples either entail a substantial storage burden when not in use, and therefore are beyond the capacity of the occasional prospector, or require an elaborate and time consuming assembly at the placer site that often is not justified by its potential.

Significantly, the material structure and density of the mined metal referred to above also focuses the primary processing efforts to those associated with classifying by particle size large volumes of the alluvial concentrate within the placer deposits. As result a variety of smaller, highly compact and easily loaded onto the bed of a pickup truck, screening and classifying mechanisms have been devised exemplified in the teachings of U.S. Pat. No. 5,423,430 to Zaffiro et al.; U.S. Pat. No. 7,591,377 to Puda et al.; U.S. Pat. No. 8,113,355 to Peterson; and many others.

While again suitable for the purposes intended, each of the foregoing entails an interruption of the manual shoveling of the placer's deposits onto one or more of the classifying screens so that the screen or screens may be then agitated or shaken to help pass the properly sized particulates therethrough for collection in buckets or trays, with the shoveling then resumed once more until the screen or screens are fully covered with the accumulated larger particulate loads. Once thus fully loaded the screens need to be lifted and emptied to allow the process to continue. These interruptions prolong to agonizing lengths the already tedious, back-breaking process and a mechanism that utilizes the movement associated with a shoveling stroke to also agitate the screen that is then easily relieved of its accumulated load directly from the shoveling stance is therefore extensively desired and it one such mechanism that is described herein.

SUMMARY OF THE INVENTION

Accordingly, it is the general purpose and object of the present invention to provide a foot articulated support structure for a classifying pan pivotally deployed above a collection receptacle, or bucket, and conformed for coordinated articulation thereof as ore bearing aggregate is shoveled into the pan.

Yet other and further objects of the present invention shall become apparent upon the review of the description that now follows in association with the illustrations appended hereto.

Briefly, these and other objects are accomplished within the present invention by way of an articulated pan support assembly defined by a pair of vertical posts mounted on a base plate in spaced separation to receive a utility bucket between them. The free upper ends of each of the posts includes a generally horizontal outwardly directed pin that are each received in sliding translation within a corresponding, generally S-shaped, slot formed in a corresponding end piece secured to the upper ends of a pair of links each pivotally connected at their respective lower ends to the legs of a generally horizontal V-shaped yoke having its legs supported at their midpoint on a pair of raised fulcrum pivots mounted on the base plate in a spacing relative the posts to align the pivoted link end of each of the yoke legs adjacent the corresponding one of the vertical posts. In this form the pin engagement of each end piece secured to the upper link end then aligns each of the links alongside their corresponding pin engaged post, an alignment further fixed by the radial dimensions of a circular hoop that is fixed by welding in a horizontal, generally opposed, diametric attachment to the respective end pieces.

The radial dimensions of the circular hoop, and also a further, equally dimensioned, overlying ring hinged at one point of its periphery to the periphery of the hoop, are each conformed to engage in suspension the peripheral edge of a pan provided with a screened bottom into which the prospected soil and particulates are shoveled while a foot pedal mounted on the yoke tongue is concurrently depressed to articulate the yoke legs about their corresponding fulcrum pivots. Thus the shoveling motion that deposits the soil particulates on a screen aligned right over the collection bucket, by its own weight transfer, is also useful to impart a concurrent reciprocal articulation of the pan as the convolved grooves in each of the end pieces translate over the pins received therein, shaking the particulates collected in the pan to advance the smaller ones thereof through the screening for collected in the bucket positioned below while the unwanted larger particulates accumulate on the screen. Once the screen is fully loaded by the larger particulates the pan supporting ring with the pan resting on it may simply be periodically pivoted about its peripheral hinge to discard the unwanted pan contents.

Of course, it will be appreciated by those in the art that the foregoing shoveling process while the screen assembly is articulated to sift the particulates that then drop though the screen into the bucket below it, along with the periodic dumping of the larger particulates off to one side, all contribute to inordinate volumes of dust that invariably exacerbates this already difficult effort. The harsh, hot and dry conditions where prospecting often occurs are made even more difficult by these surrounding clouds of dust and to confine most of it to a vertical column centered directly over the collection bucket a nested set of frustoconical elastomeric membrane segments are loosely suspended at their larger peripheries from the lower edge of the post supported hoop to deploy their concentric narrower lower openings within the bucket by ballast weights tied to their lower edges.

To minimize the outward agitation of the particulate matter as it descends into the bucket the outer frustoconical segment membrane includes a dispersed array of perforations with the inner segment membrane nested within it including a coincident array of downwardly depending U-shaped flaps each dimensioned to bridge across the much smaller perforations of the outer segment membrane to form a plurality of cooperative flapper check valve combinations that impart an air movement bias into a column centered within the collection bucket while limiting most of the outward air momentum exchange.

In this manner the cloud of dust that usually surrounds the process is minimized as the solitary prospector both shovels and agitates the material on the screen to assist in its particle size classification, continuously loading the elevated pan to its capacity at its raised, waist high, deployment and then simply discard the larger residue on the screen by pivoting the loaded pan about its hinge. Significantly, these same mechanical attributes that provide the foregoing advantages also align the prospector's face and breathing away from the agitated soil and the dust that may persist as the classification task continues, a benefit that is particularly useful in hot, remote settings where effective prospecting is most likely. All these advantages are obtained in a structure that is easily broken down for transport, in which only few parts like the grooves in the end pieces, are subject to significant wear but which by virtue of their small size may be easily carried as a redundant replacement ring.

DESCRIPTION OF THE PREFERRED EMBODIMENTS

Figure 1:
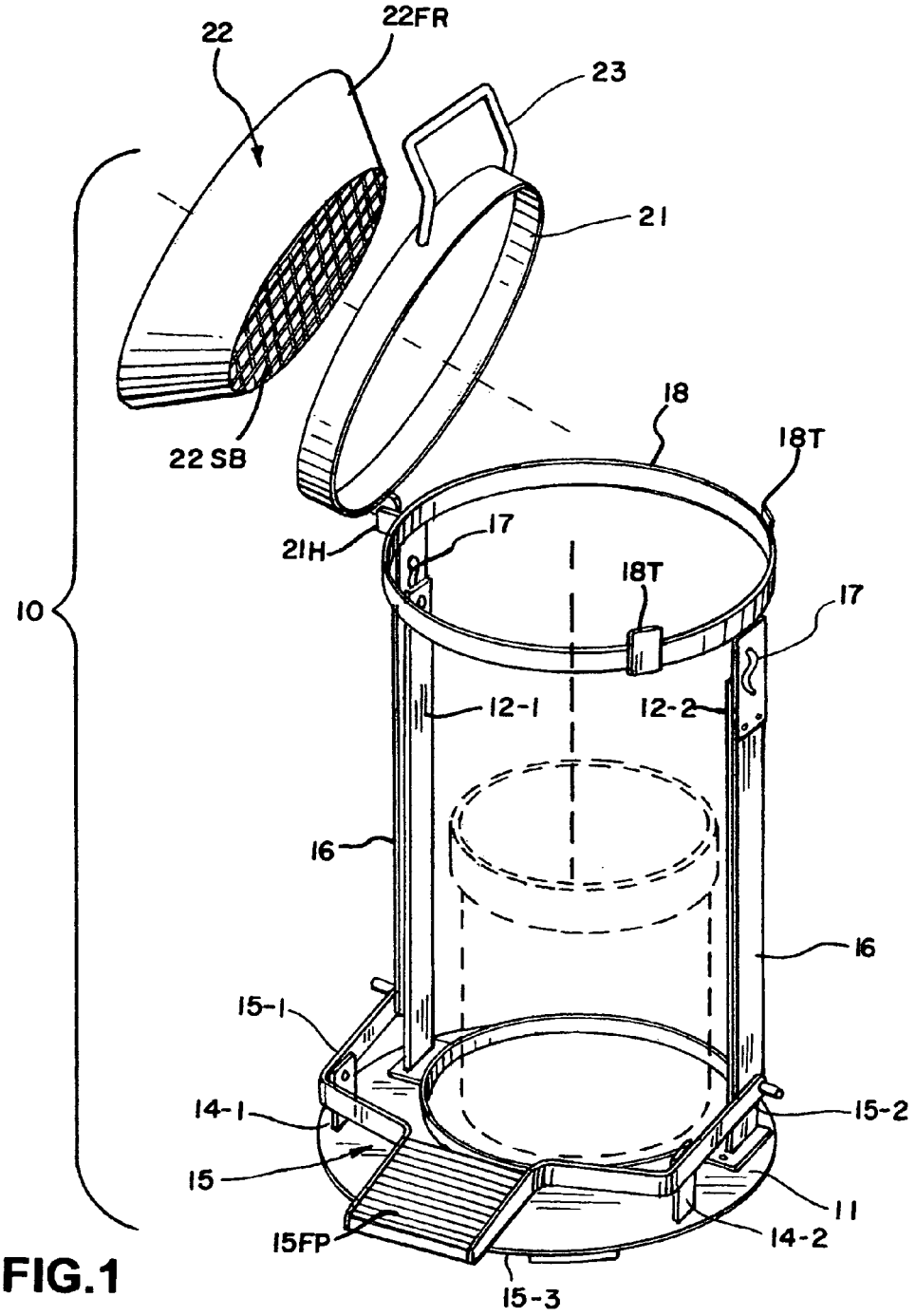
FIG. 1 is a perspective illustration, separated by parts, of the inventive screen shaker assembly in its deployed form.
Figure 2:
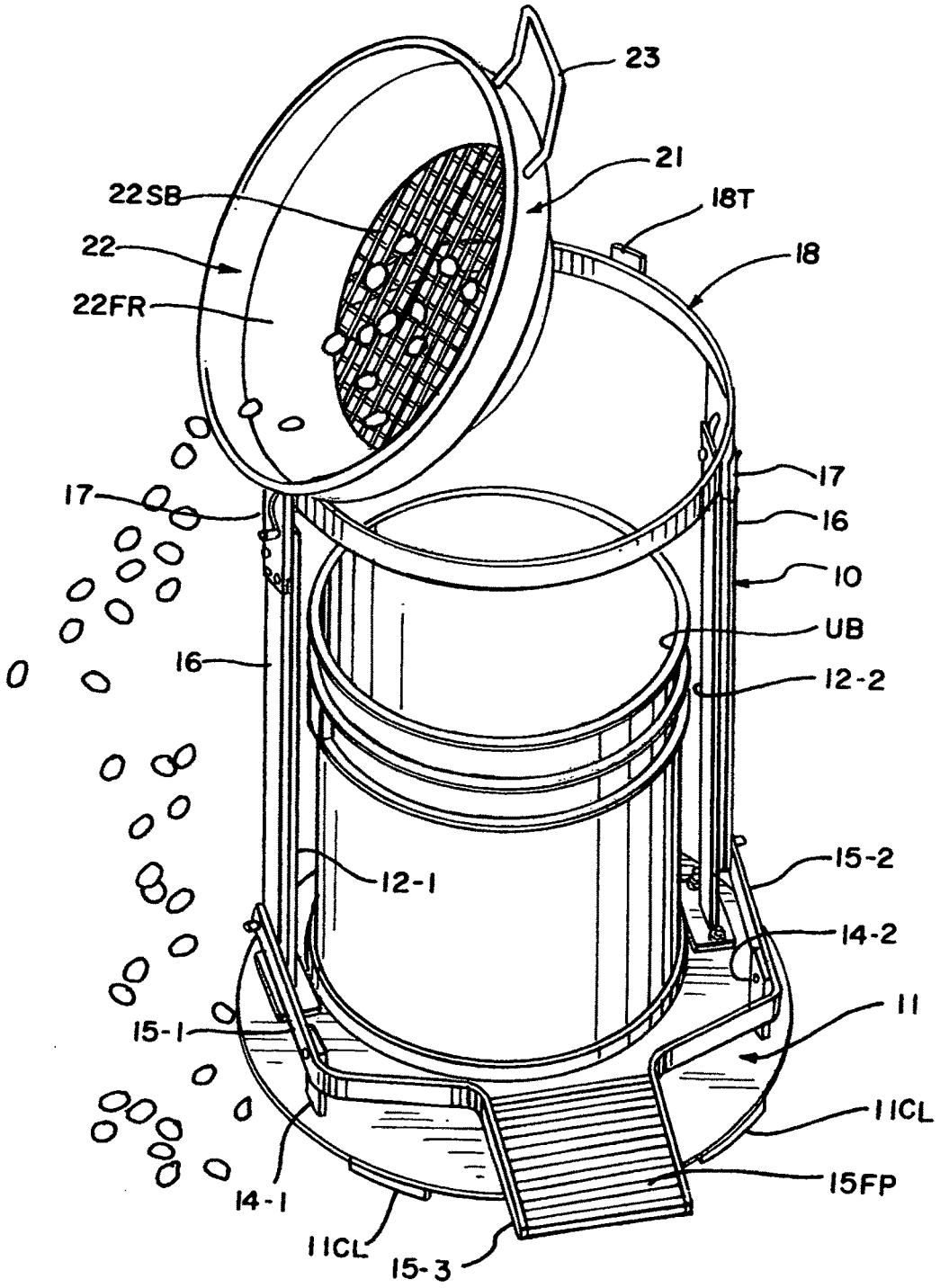
FIG. 2 is yet another perspective illustration of the inventive shaker assembly shown in FIG. 1 articulated to discard the particulate matter collected on the screen thereof.
Figure 3A:
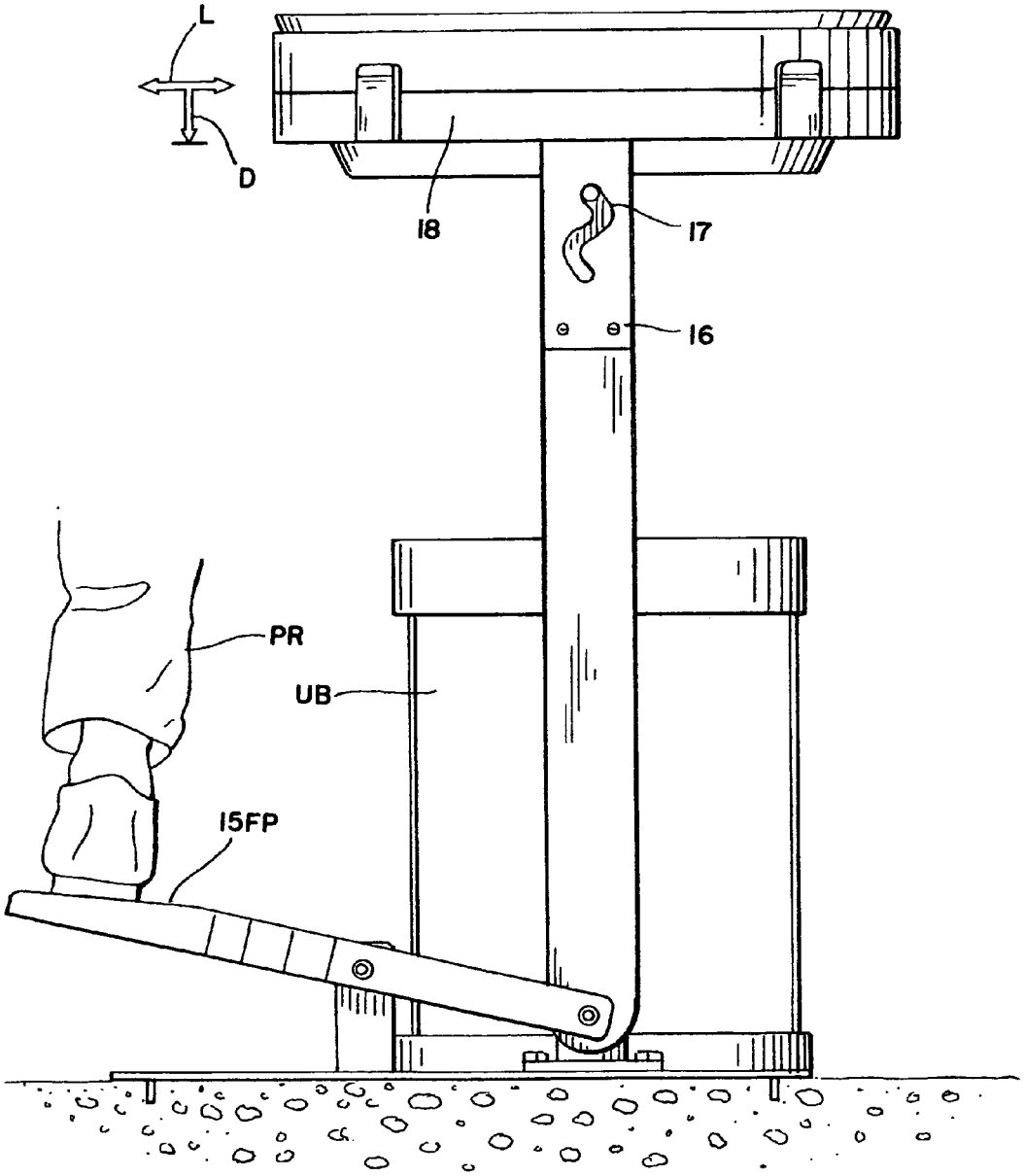
FIGS. 3A and 3B are each side view illustrations of the inventive screen shaker assembly respectively at the upper and lower limits of the articulation stroke thereof.
Figure 3B:
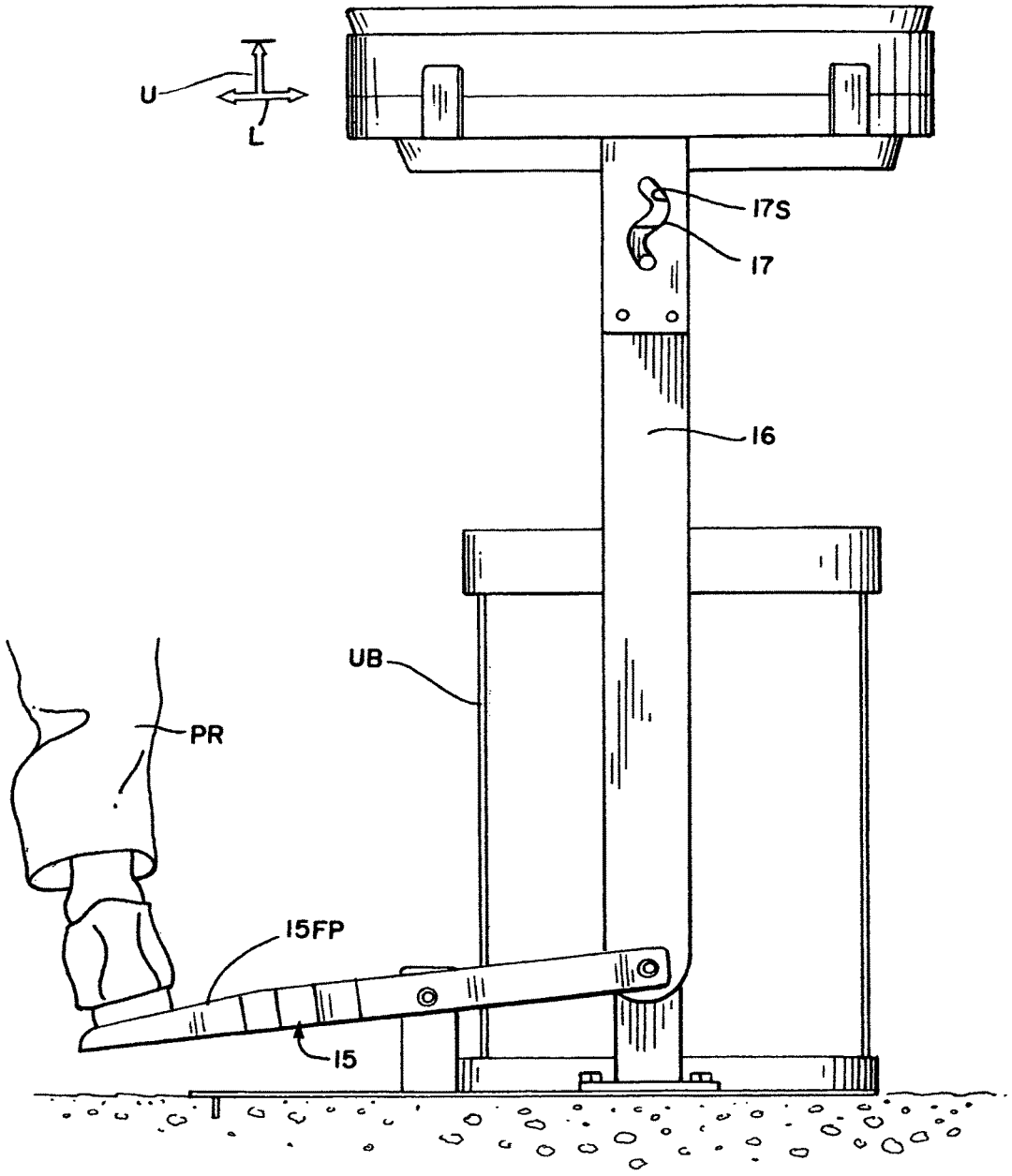
Figure 4:
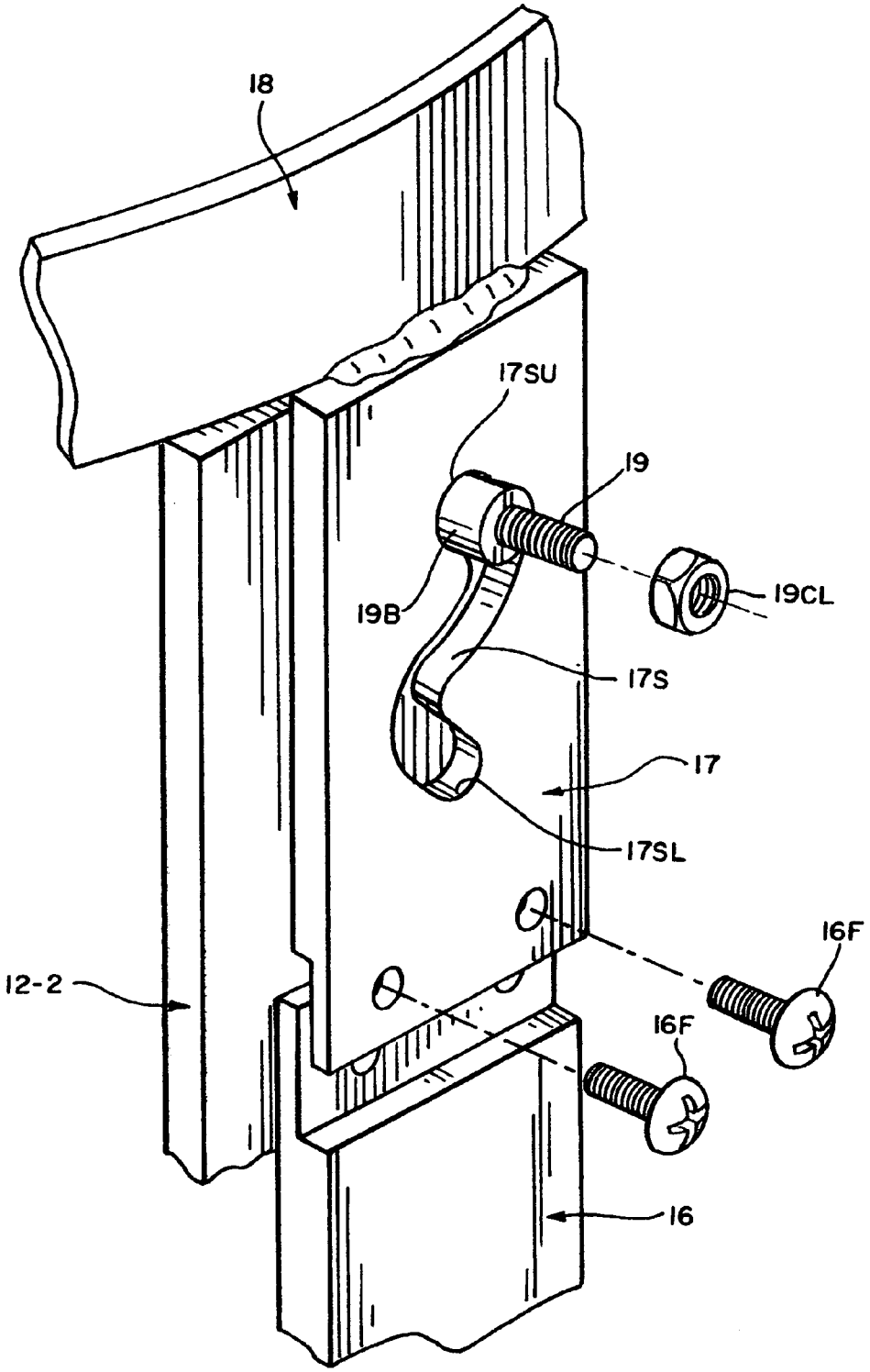
FIG. 4 is a detail illustration in perspective of a reciprocal shaking mechanism useful to impart shaking movement to a screened pan or receptacle in accordance with the present invention.

As shown in FIGS. 1 through 4 the first embodiment of the inventive screen shaker assembly, generally designated by the numeral 10, comprises a base plate 11 on which a pair of vertical posts 12-1 and 12-2 are mounted separated from each other by a spacing gap sufficient to accommodate a utility bucket or other similar container UB. Base plate 11 also supports in vertical projection a further pair of fulcrum pivots 14-1 and 14-2 each spaced from the corresponding vertical posts 12-1 and 12-2 and respectively pinned to a corresponding leg 15-1 and 15-2 of a V-shaped yoke assembly 15 to align the leg ends adjacently exterior of the corresponding posts with the opposingly directed yoke tongue 15-3 then provided with a pedal or foot pad 15FP.

The free ends of each of the legs 15-1 and 15-2, as they respectively extend along the exterior of each of the posts 12-1 and 12-2 are each pivotally pinned to the corresponding lower ends of a pair of vertical links 16 aligned generally vertically along the corresponding exteriors of the posts to attach by fasteners 16F at their upper ends to a corresponding pair of end pieces 17 each welded in a diametrically spaced attachment to the lower edge of a circular hoop 18. By particular reference to FIG. 4, each of the end pieces 17 includes a vertically aligned S-shaped groove or slot 17S terminating in an upper end 17SU and a lower end 17SL conformed to receive a bushing 19B surrounding the shank of an outwardly directed pin 19 that extends through the free upper end of the vertical posts 12-1 and 12-2 (and illustrated herein by reference to post 12-2). Like numbered parts functioning in a like manner as herein described, each of the pins 19 includes a threaded end 19TE that is secured by a locknut 19LC to insure a captive engagement of the pins 19 within their corresponding slots 17S as the prospector PR articulates the yoke 15 about its fulcrum pivots 15-1 and 15-2 to impart the up and down articulation of the links 16 as the prospected soil is shaken both up and down and also laterally as illustrated by arrows U and L in FIG. 3B and D and L in FIG. 3A.

A mounting ring 21 equally dimensioned as hoop 18 is hinged by a hinge 21H projecting from its periphery to the periphery of hoop 18 and aligned thereon by a plurality of vertical tabs 18T to form a seat for a screened pan assembly 22 defined by a peripheral frustoconical funneling panel 22FR that surrounds a screened bottom 22SB into which the prospected soil is shoveled by prospector PR and concurrently agitated along with the shoveling strokes, as described above. Once the pan is fully loaded with the unwanted, larger particulates a handle 23 generally diametrically spaced from hinge 22H may be utilized to discard the accumulate, allowing the prospector to accumulate in the bucket UB the more promising small sized particulates that have been promoted by the high specific gravities of precious metals that are preferred in the loading and unloading end impacts against the upper and lower slot ends 17SU and 17SL.

In this manner the tedious, back-breaking effort of selecting the smaller and more dense particulates of a placer deposit is greatly simplified, allowing some vigorous attention to the whole prospecting task. Of course, the provision of cleats 11CL on the underside of the base plate 11 may safeguard against any inadvertent movements of the assembly once the process is commenced, thereby assuring an uninterrupted continuation of the task until the desired results are obtained.

Figure 5:
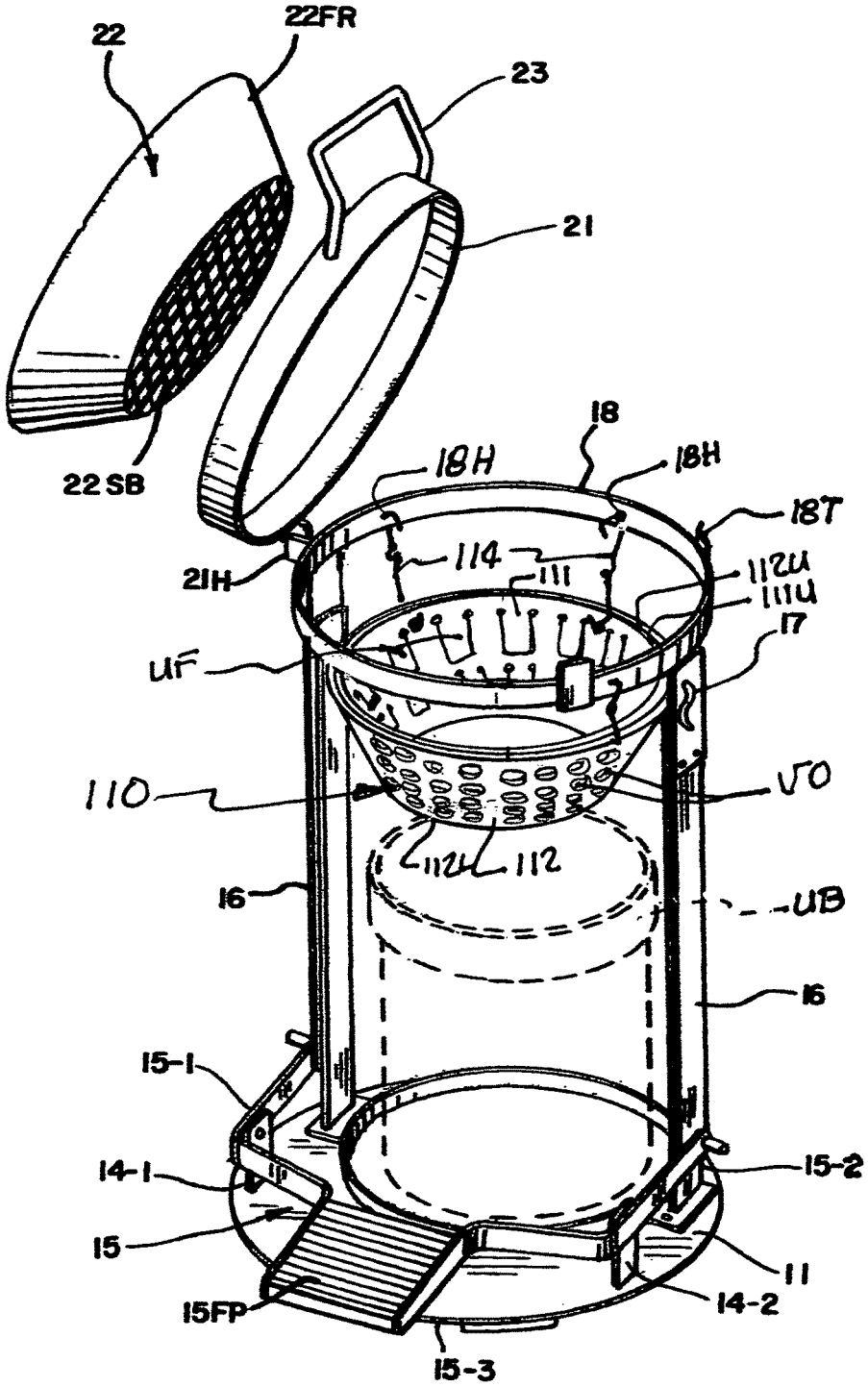
FIG. 5 is a further perspective illustration of the inventive structure shown in FIG. 1 modified to incorporate therewith as an alternative embodiment of the instant invention a dust confinement assembly that includes a self-effected closure limiting the outward dispersal of dust upon the outward movement thereof.
Figure 6:
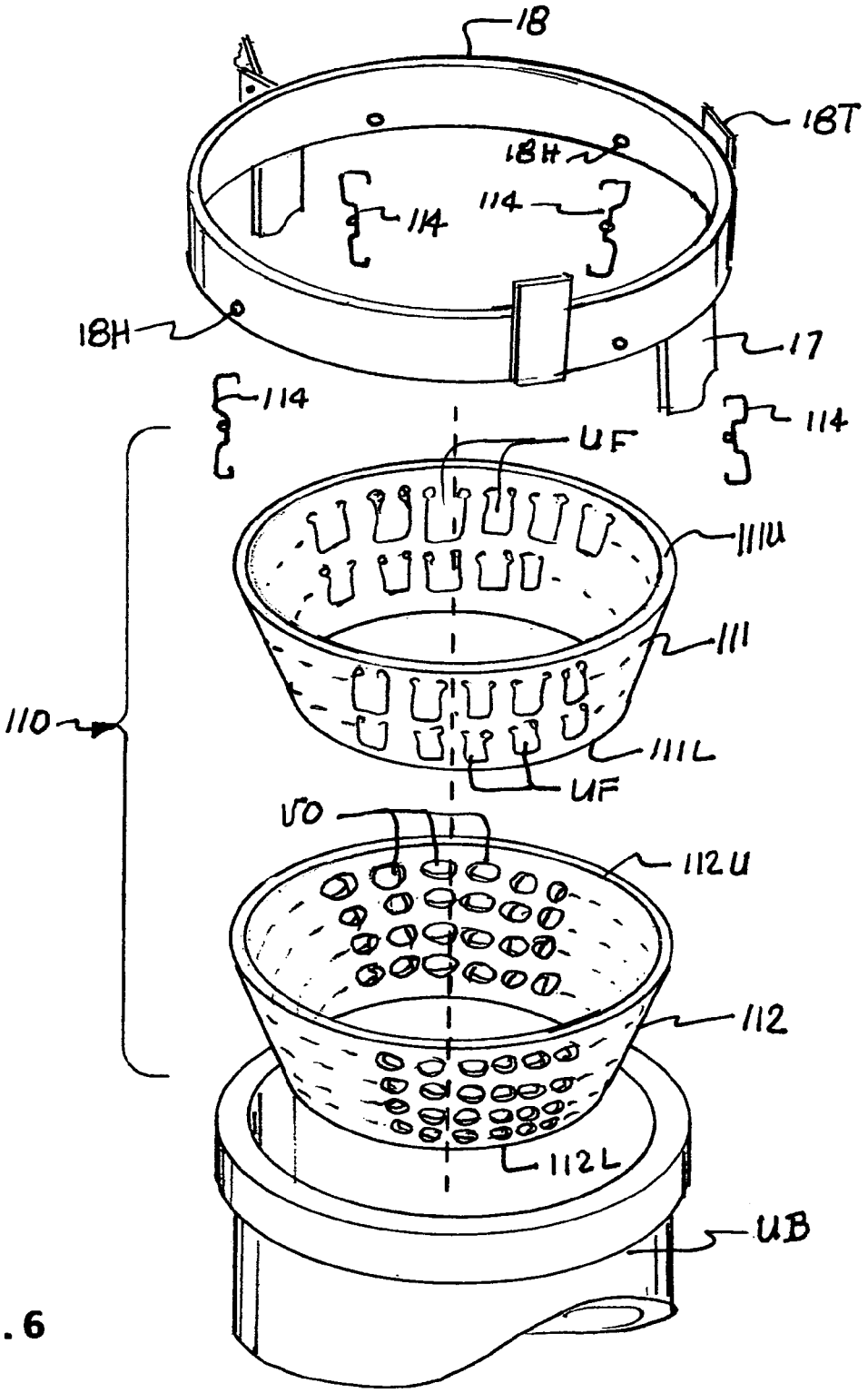
FIG. 6 is a yet further perspective illustration, separated by parts, illustrating the suspended arrangement for coherent articulation of the inventive dust confinement assembly shown in FIG. 5.
Figure 7B:
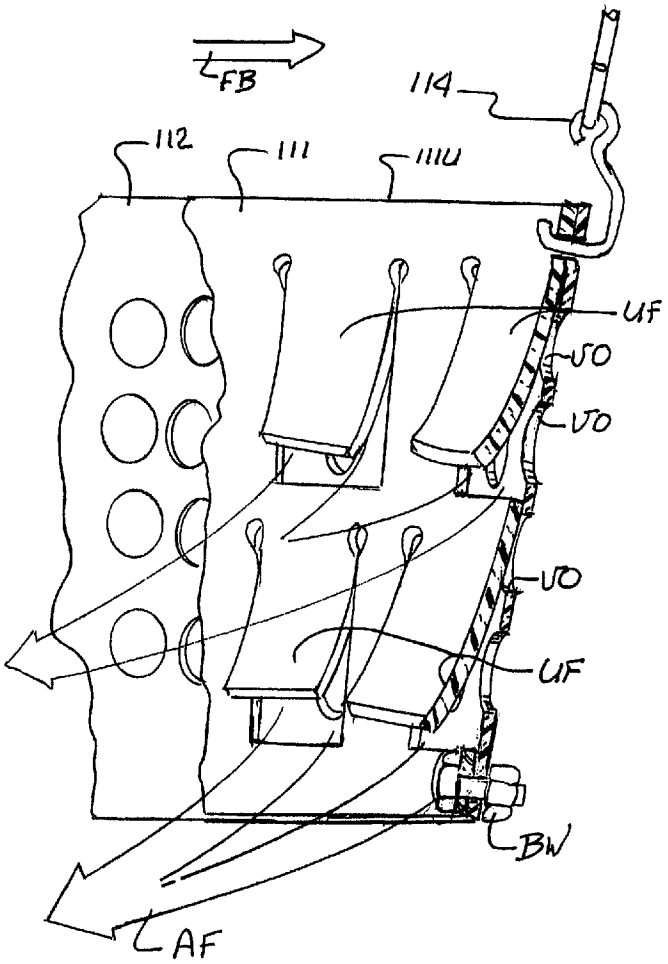
FIGS. 7A and 7B are each diagrammatic illustrations depicting the inventive movements of portions of the inventive confinement assembly shown in FIGS. 5 and 6 in accordance with the direction of movement thereof.
Figure 7A:
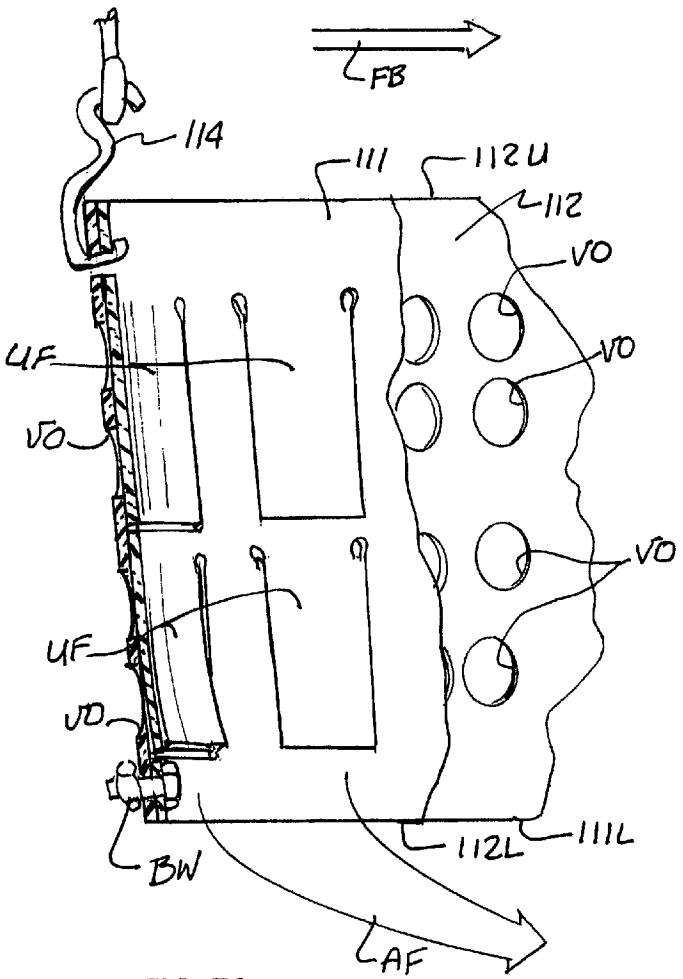

By particular reference to FIGS. 5, 6, 7A and 7B the usefulness of the foregoing implementation may be even further enhance by way of a generally frustoconical dust confinement assembly generally designated by the numeral 110 comprising an inner frustoconical elastomeric membrane segment 111 nested within a conformingly dimensioned outer frustoconical elastomeric segment 112 that are held together in their nested form by a set of releasable hangers 114 engaged at spaced intervals to the upper edges 111U and 112U of the corresponding segments 111 and 112 that define the larger periphery of this nested frustoconical combination. Like numbered parts functioning in the same manner as previously described, the free ends of hangers 114 are then each selectively engaged in a corresponding one of a set of openings 18H also formed at spaced increments along the lower edge of hoop 18, thus forming a hanging attachment mechanism by which assembly 110 is suspended from the hoop 18 to align its smaller opening defined by their nested lower edges 111L and 112L above the top opening of the collection bucket UB as these lower opening edges are joined and ballasted downwardly by a plurality of common nut and bolt sets combining as ballast weights BW.

To impart an inwardly directed air flow bias shown by the arrows FB as the assembly 110 is laterally oscillated with the movements of hoop 18 at the oscillation rate of the ballasted combination the outer elastomeric segment 112 is pierced by a plurality of small ventilation openings VO throughout its full surface while the inner membrane segment 111 includes a set of downwardly depending U-shaped cuts each extending downwardly between stress relieving perforations to form a set of U-shaped flaps UF that are each dimensionally greater than the size and spacing of the ventilation openings VO. By this dimensional mismatch the much larger flaps UF bridge across the ventilation openings VO, shutting off air transfer through that portion of assembly 110 illustrated in FIG. 7A when the movement direction is along arrows FB while lifting off this bridging alignment of flaps UF during the opposite part of the swing. In this the major part of the air flow AF is aligned towards the center of the collection bucket UB, minimizing the dust levels outside the collection area where the heavy physical effort is carried out. Of course, the foregoing ventilation transfers are reversed during the reverse part of the pendulum motion of the assembly.

Those skilled in the art will appreciate that this dust confining function can be easily carried out by way of inexpensive elastomeric sheet structures in which the relief openings at the end of each vertical leg of the U-shaped cut of each flap UF defines a high compliance hinging region from which the rest of the flap is suspended, assuring a well-controlled movement pattern of the combination. Moreover, the arrangement of this dust controlling mechanism as a pendulum will confine its primary movement modes to that of a pendulum, attenuating the higher energy, higher frequency movements that are imparted to the rest of the structure to limit wear. In this manner, a light and easily assembled structure is devised to further enhance the usefulness of this apparatus.

Obviously many modifications and variations of the instant invention can be effected without departing from the spirit of the teachings herein. It is therefore intended that the scope of the invention be determined solely by the claims appended hereto.

It is claimed:

1. A pedal actuated apparatus for imparting sifting movement to a screen containing granular matter therein concurrent with the manual translation of additional granular matter into said screen, comprising:

a generally vertical support frame conformed to include an interior space for receiving a collection receptacle at the lower end thereof and including a convolved movement restraint for articulating said screen upon the movement of said pedal;

an annular dust confining assembly suspended below said screen and including a nested set of frustoconical segments comprising a perforated exterior segment and a conforming interior segment provided with flexible flaps bridging across selected portions of said exterior segment.

2. An apparatus according to claim 1, wherein:

said sifting movement imparted to said screen is generally orthogonal to said vertical support frame.

3. An apparatus according to claim 2, wherein:

selected ones of said flexible flaps are displaced from bridging across said selected portions of said exterior segment in the course of said sifting movement.

4. An apparatus according to claim 1, wherein:

said interior segment includes an elastomeric membrane.

5. An apparatus according to claim 4, wherein:

said sifting movement imparted to said screen is generally orthogonal to said vertical support frame.

6. An apparatus according to claim 5, wherein:

selected ones of said flexible flaps are displaced from bridging across said selected portions of said exterior segment in the course of said sifting movement.

* * * * *